United States Patent [19]

Bennett

[11] 4,064,990

[45] Dec. 27, 1977

[54] PACKAGE FOR WRAPPING PAPER

[75] Inventor: Walter E. Bennett, Fitchburg, Mass.

[73] Assignee: Fox Valley Corporation, Appleton, Wis.

[21] Appl. No.: 692,559

[22] Filed: June 3, 1976

[51] Int. Cl.[2] ..... B65D 85/62

[52] U.S. Cl. ..... 206/494; 206/215; 206/449

[58] Field of Search ..... 206/215, 494, 449; 221/46, 48, 63, 55

[56] References Cited

U.S. PATENT DOCUMENTS

| | | | |
|---|---|---|---|
| 1,028,084 | 5/1912 | Bond | 206/494 |
| 1,714,314 | 5/1929 | Neidich | 206/215 |
| 2,320,955 | 6/1943 | Thomasma | 206/494 |
| 2,471,145 | 5/1949 | Erickson | 206/494 |
| 3,048,425 | 8/1962 | Fleischmann | 206/215 |

*Primary Examiner*—William T. Dixson, Jr.
*Assistant Examiner*—Douglas B. Farrow
*Attorney, Agent, or Firm*—Kinzer, Plyer, Dorn & McEachran

[57] ABSTRACT

A package containing a number of folds of decorative wrapping paper. Each fold is formed of at least one sheet of decorative wrapping paper which is folded so that it forms a fold having a front panel and a rear panel connected along a backbone. The front panels of the various folds, comprising the package, are of different lengths. In the package, the folds are nested one inside another with the backbones next to one another, and the front panels are arranged with panels of greater lengths located inwardly of panels of shorter length so that all of the front panels are visible when the folds are nested in the package. In one form of package having two nests of folds, the nests are positioned so that the rear panels of the folds of one nest are against the rear panels of the folds of the other nest and the backbones of the folds of the respective nests are located at opposite ends of the package. In this arrangement, the front panels of all of the folds of both nests are visible.

4 Claims, 3 Drawing Figures fig.1.
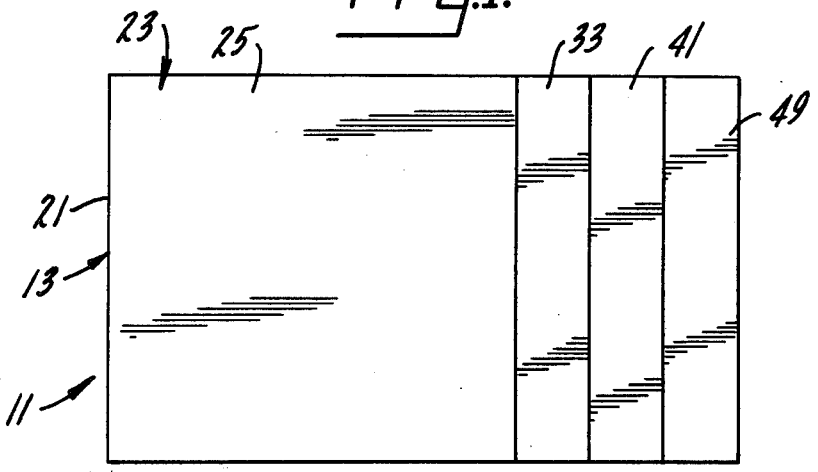
fig.2.
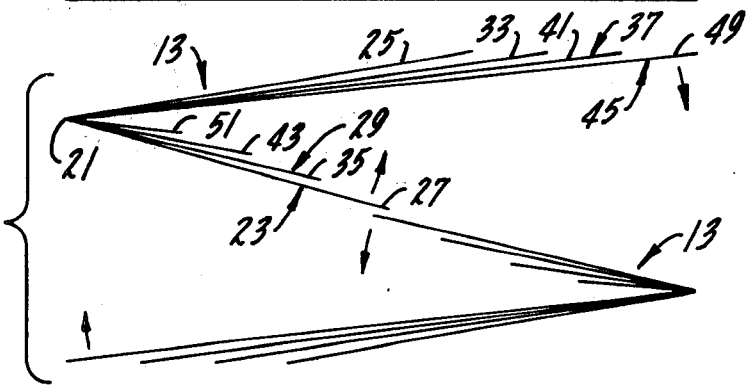
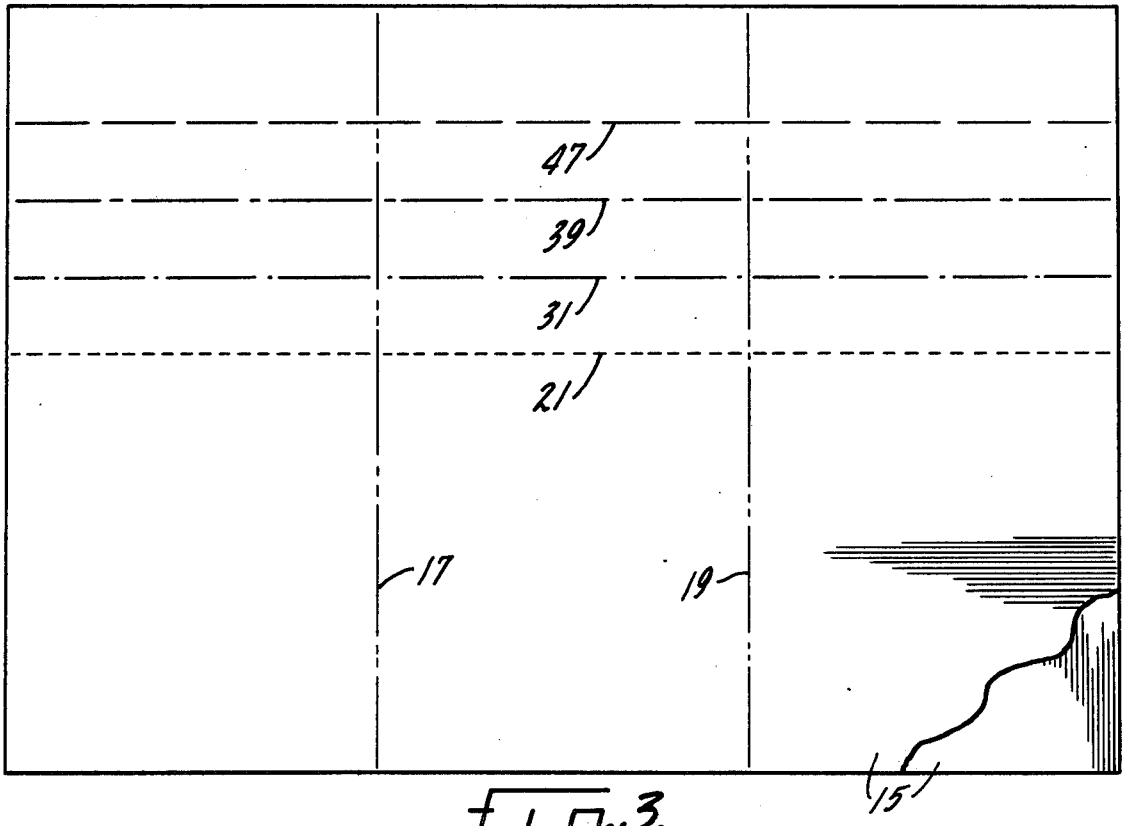
fig.3.

PACKAGE FOR WRAPPING PAPER

SUMMARY OF THE INVENTION

This invention is directed to a package containing a number of folds of decorative wrapping paper, especially wrapping paper of different designs.

An object of this invention is a relatively thin, compact package for a number of folds of decorative wrapping paper in which the design of the wrapping paper of each fold is visible in the assembled package.

Another object is a package containing a number of folds of decorative wrapping paper which package is of generally constant thickness.

Another object is a package containing a number of folds of decorative wrapping paper in which each fold of paper is visible in a shingle arrangement.

Another object is a package for folds of decorative wrapping paper in which the number of sheets of paper in a fold and the number of folds can be varied.

Other objects may be found in the following specification, claims and drawings.

BRIEF DESCRIPTION OF THE DRAWINGS

The invention is illustrated more or less diagrammatically in the following drawings wherein:

FIG. 1 is a top plan view of a package embodying the novel features of this invention;

FIG. 2 is an end elevational view of the package of FIG. 1 with the folds spread apart for clarity of illustration; and FIG. 3 is a view of a partially assembled fold formed of two sheets of decorative wrapping paper, and showing alternate fold lines for forming the different folds of a nest.

DESCRIPTION OF THE PREFERRED EMBODIMENTS

FIGS. 1 and 2 of the drawings show a package 11 having eight folds of decorative wrapping paper arranged in two nests 13 so that all folds are visible in the assembled package. Each fold is formed from one or more sheets 15 of decorative wrapping paper. Customarily, all the sheets of a fold are of the same design. In this embodiment of the invention, each fold is formed from two sheets of wrapping paper but it should be understood and appreciated that the number of sheets of decorative wrapping paper in each fold may vary in accordance with many factors, such as the weight and type of paper used and the total quantity of paper to be included in the package 11.

In this embodiment of the invention, each sheet 15 of decorative wrapping paper is approximately 30 inches long and 20 inches wide, having been cut from a 20, 26 or 30 inch wide roll of paper. Of course, the sheets of paper can be of any other convenient dimensions, 20 inches by 26 inches being another example. To form a fold, two sheets of paper are placed one upon the other as shown in FIG. 3 and are folded about transversely extending lines 17 and 19 into an assembly having a length of 20 inches (the previous width of the sheet) and a width of 10 inches. This assembly is then folded about a transversely extending line which becomes the backgone 21 of a fold 23. The backbone 21 divides the fold 23 into a front panel 25 and a rear panel 27. The front panel is formed so as to be slightly longer than the rear panel and in this embodiment, the front panel is approximately 11 inches in length and the rear panel is approximately 9 inches in length. The other folds of the nest are formed in the same manner with the only change being the location of the line which becomes the backbone of the fold. The lines which form the backbones for all of the folds of a nest are indicated in FIG. 3.

The fold 23 is positioned as the outermost fold in each nest 13 and thus has the shortest front panel and the longest rear panel of the folds in the nest. The next fold 29 of the nest is folded to have a backbone 31 dividing the fold into a front panel 33 and a rear panel 35. The front panel has a length of approximately 13 inches and the rear panel has a length of approximately 7 inches. In assembling a nest 13, the front panel 33 of fold 29 is located just inwardly of and against the front panel 25 of fold 23. Likewise, the rear panel 35 of this fold is located just inwardly of and against the rear panel 27 of fold 23.

The next fold 37 of the nest has a backbone 39 which divides the fold into a front panel 41 and a rear panel 43. The front panel of this fold has a length of approximately 15 inches and the rear panel has a length of approximately 5 inches. In the nest, the front panel 41 of fold 37 is located just inwardly of and against the front panel 33 of fold 29 and the rear panel 43 of this fold is located just inwardly of and against the rear panel 35 of fold 29. The innermost fold 45 has a backbone 47 dividing the fold into a front panel 49 and a rear panel 51. The front panel has a length of approximately 17 inches and the rear panel has a length of approximately 3 inches. When the folds 23, 29, 37 and 45 are nested in the manner shown in FIG. 1, the front panels 25, 33, 41 and 49 of the folds will be visible from one side of the nest.

In assemblying a package 11, a pair of nests 13 of identical construction are placed together in the manner shown in FIG. 2 with the rear panels of the folds of one nest contacting the rear panels of the folds of the other nest. Thus, the front panels of each nest will be facing outwardly. In order to provide a constant thickness for the package, the backbones of one nest will be located on the opposite end of the package from the backbones of the other nest. Thus, the package will have a generally uniform thickness. The assembled package is usually enclosed in a transparent wrapper, preferably a heat shrink plastic film. However, it should be understood that other type of transparent wrappers may be used.

The package 11 shown and described as the preferred embodiment has two nests 13 of four folds each. It should be understood that the package could be assembled with 3, 4, 5, 6, 7, 8, 9 or 10 folds. For example, a package could be assembled with two nests of five folds each; or a package could be put together having two nests, one of which has four folds and the other has three folds. Another packaging arrangement would be two nests of three folds each. Yet another packaging arrangement could have one nest with three folds. When the number of folds in a nest are changed, it may also be necessary or desirable to change the lengths of the front and rear panels of the fold. However, the arrangements of the folds in the nest would remain the same in order to obtain the advantages of this invention. For this reason, the scope of this invention should be determined by the liberal interpretation of the claims appended hereto.

I claim:

1. A package for folds of decorative wrapping paper, said package including:

two nests of folds, each nest of folds including a plurality of folds, each fold being formed of at least one sheet of decorative wrapping paper and having a front panel and a rear panel immediately connected to each other at a backbone, said front panels of each nest being of different lengths, said folds being nested one inside the other with the backbones located adjacent to one another and the front panels arranged with longer panels located inwardly of the shorter panels so that all of the front panels of a nest are visible in the nested position of the folds, each front panel being at least as long as its rear panel, and said nests being positioned so that the rear panels of the fold of one nest are adjacent the rear panels of the folds of the other nest and the backbones of the nests are located at opposite ends of the package.

2. The package of claim 1 in which the sum of the length of the front and rear panels of each fold are equal.

3. The package of claim 1 in which each fold contains at least two sheets of decorative wrapping paper.

4. The package of claim 1 in which said backbone is a creased fold.

* * * * *